US008563080B2

(12) United States Patent
Hopkins

(10) Patent No.: US 8,563,080 B2
(45) Date of Patent: Oct. 22, 2013

(54) METHOD OF REPAIRING A DAMAGED ABRADABLE COATING

(75) Inventor: Noel Paul Hopkins, Derby (GB)

(73) Assignee: Rolls-Royce PLC, London (GB)

( * ) Notice: Subject to any disclaimer, the term of this patent is extended or adjusted under 35 U.S.C. 154(b) by 1267 days.

(21) Appl. No.: 12/073,012

(22) Filed: Feb. 28, 2008

(65) Prior Publication Data

US 2008/0233278 A1 Sep. 25, 2008

(30) Foreign Application Priority Data

Mar. 24, 2007 (GB) ..... 0705696.3

(51) Int. Cl.

| | |
|---|---|
| ***B05D 3/00*** | (2006.01) |
| ***B05C 13/00*** | (2006.01) |
| ***B41N 1/24*** | (2006.01) |
| ***B05D 5/10*** | (2006.01) |
| ***B05D 7/22*** | (2006.01) |

(52) U.S. Cl.
USPC ..... 427/142; 427/140; 427/207.1; 427/239

(58) Field of Classification Search
USPC ..... 427/140, 142, 207.1, 239
See application file for complete search history.

(56) References Cited

U.S. PATENT DOCUMENTS

| | | | | |
|---|---|---|---|---|
| 3,723,165 | A * | 3/1973 | Longo et al. | 427/447 |
| 3,975,165 | A * | 8/1976 | Elbert et al. | 428/550 |
| 4,578,114 | A * | 3/1986 | Rangaswamy et al. | 75/252 |
| 4,625,280 | A * | 11/1986 | Couch | 701/100 |
| 5,506,055 | A * | 4/1996 | Dorfman et al. | 428/407 |
| 5,536,022 | A | 7/1996 | Sileo et al. | |
| 5,605,590 | A * | 2/1997 | Manning et al. | 156/94 |
| 5,951,892 | A * | 9/1999 | Wolfla et al. | 219/121.69 |
| 6,010,746 | A * | 1/2000 | Descoteaux et al. | 427/142 |
| 6,827,969 | B1 * | 12/2004 | Skoog et al. | 427/142 |
| 6,916,529 | B2 * | 7/2005 | Pabla et al. | 428/325 |
| 7,160,352 | B2 * | 1/2007 | Le Biez et al. | 75/252 |
| 2005/0129976 | A1 * | 6/2005 | Turnquist et al. | 428/680 |
| 2005/0200842 | A1 | 9/2005 | Bonningue et al. | |

(Continued)

FOREIGN PATENT DOCUMENTS

| | | |
|---|---|---|
| EP | 0 990 468 A1 | 4/2000 |
| EP | 1 146 987 B1 | 1/2004 |

(Continued)

OTHER PUBLICATIONS

Maynard et al, Manifold Destiny: The One! The only Guild to cooking on your car engine, 1989, Simon & Schuster Paperbacks.*

(Continued)

*Primary Examiner* — Michael Cleveland
(74) *Attorney, Agent, or Firm* — Oliff & Berridge, PLC

(57) ABSTRACT

A method of repairing a damaged abradable coating (48) on a surface (46) of a shroud (44) in an assembled gas turbine engine (10) comprises inserting a boroscope (60) through an aperture (52) in the casing (50) of the compressor (26) of the gas turbine engine (10). The boroscope (60) is arranged to carry a conduit (62). The boroscope (60) and hence the conduit (62) are directed to the damaged abradable coating (48) on the surface (46) of the shroud (44). A liquid abradable glue (64) is supplied through the conduit (62) and the liquid abradable glue (64) is directed onto the surface (46) of the shroud (44) in the compressor (26) of the gas turbine engine (10) to repair the damaged abradable coating (48).

15 Claims, 2 Drawing Sheets

(56) References Cited

U.S. PATENT DOCUMENTS

| | | | | |
|---|---|---|---|---|
| 2005/0235493 | A1* | 10/2005 | Philip et al. | 29/889.1 |
| 2006/0042083 | A1 | 3/2006 | Baker et al. | |
| 2006/0289496 | A1* | 12/2006 | Kelly | 219/679 |
| 2007/0048140 | A1* | 3/2007 | Farr et al. | 416/193 A |

FOREIGN PATENT DOCUMENTS

| | | | |
|---|---|---|---|
| EP | 1 658 925 | A1 | 5/2006 |
| EP | 1 739 145 | A1 | 1/2007 |
| GB | 791568 | A | 3/1958 |
| JP | 52-062333 | A | 5/1977 |
| JP | 56-105844 | A | 8/1981 |
| JP | A-05-168714 | | 7/1993 |
| WO | WO 98/26158 | A1 | 6/1998 |

OTHER PUBLICATIONS

European Search Report dated Apr. 8, 2011 in European Patent Application No. 08 25 0640.

* cited by examiner

METHOD OF REPAIRING A DAMAGED ABRADABLE COATING

The present invention relates to a method of repairing a damaged abradable coating, in particular to a method of repairing a damaged abradable coating on a surface in an assembled engine, particularly a gas turbine engine.

The compressors and turbines of gas turbine engines are provided with abradable coatings at various positions. In particular abradable coatings are provided on the radially inner surfaces of compressor stator component surrounding the compressor rotor blades and abradable coatings are provided on the radially inner surfaces of turbine stator components surrounding turbine rotor blades. Abradable coatings may be provided on other surfaces of other components at other positions.

Currently damaged abradable coatings on components of the gas turbine engine are repaired, or reworked, at overhaul facilities. The repair of the abradable coating involves removing the damaged, or defective, abradable coating before applying a new abradable coating of the same composition/similar composition. The abradable coating is applied by thermal spraying or by plasma spraying. The cost associated with a scheduled overhaul visit, the cost of the abradable coating powder and the spraying time, are relatively small.

However, if an abradable coating is damaged and requires repair at unscheduled overhaul, the costs are more significant. This is due to the requirement to take the gas turbine engine to an overhaul facility and to disassemble the gas turbine engine into its modules, before the damaged abradable coating may be repaired by flame spraying or plasma spraying with a new abradable coating. Even minor damage to an abradable coating may lead to an unscheduled repair, which requires the removal of the compressor module or even the entire gas turbine engine from an aircraft. There are very high costs associated with this type of unscheduled overhaul.

Currently there are no methods of repairing a damaged abradable coating while the gas turbine engine in situ, e.g. while the gas turbine engine is located on an aircraft or on a ship or in an industrial plant.

Accordingly the present invention seeks to provide a novel method of repairing an abradable coating, which reduces, preferably overcomes, the above-mentioned problem.

Accordingly the present invention provides a method of repairing a damaged abradable coating on a surface in an assembled engine, the method comprising the steps of (a) inserting a boroscope through an aperture in a casing of the engine, the boroscope carrying a conduit, (b) directing the boroscope to the damaged abradable coating on the surface, (c) supplying a liquid abradable glue through the conduit, (d) directing the liquid abradable glue onto the surface in the engine to repair the damaged abradable coating.

Preferably the method comprises an additional step of heating the liquid abradable glue such that the liquid abradable glue hardens. Preferably the method comprises running the engine for a predetermined time to harden the abradable glue.

Preferably the liquid abradable glue comprises silica powder, sodium silicate and a dislocator. Preferably the dislocator comprises polyester, graphite or hexagonal-boron nitride.

Preferably the engine comprises a gas turbine engine.

Preferably the surface is a surface of a compressor stator component or a surface of a turbine stator component.

The damaged abradable coating may comprise a plasma sprayed abradable coating or a thermally sprayed abradable coating.

The damaged abradable coating may comprise aluminium, silicon and hexagonal boron nitride clad powder. The damaged abradable coating may comprise 12 wt % silicon, 16 wt % hexagonal boron nitride and the balance aluminium.

The damaged abradable coating may comprise aluminium, silicon and polyester. The damaged abradable coating may comprise 7 wt % silicon, 40 wt % polyester and the balance aluminium.

The damaged abradable coating comprises MCrAlY and bentonite.

The present invention will be more fully described by way of example with reference to the accompanying drawings in which.

Figure 1:
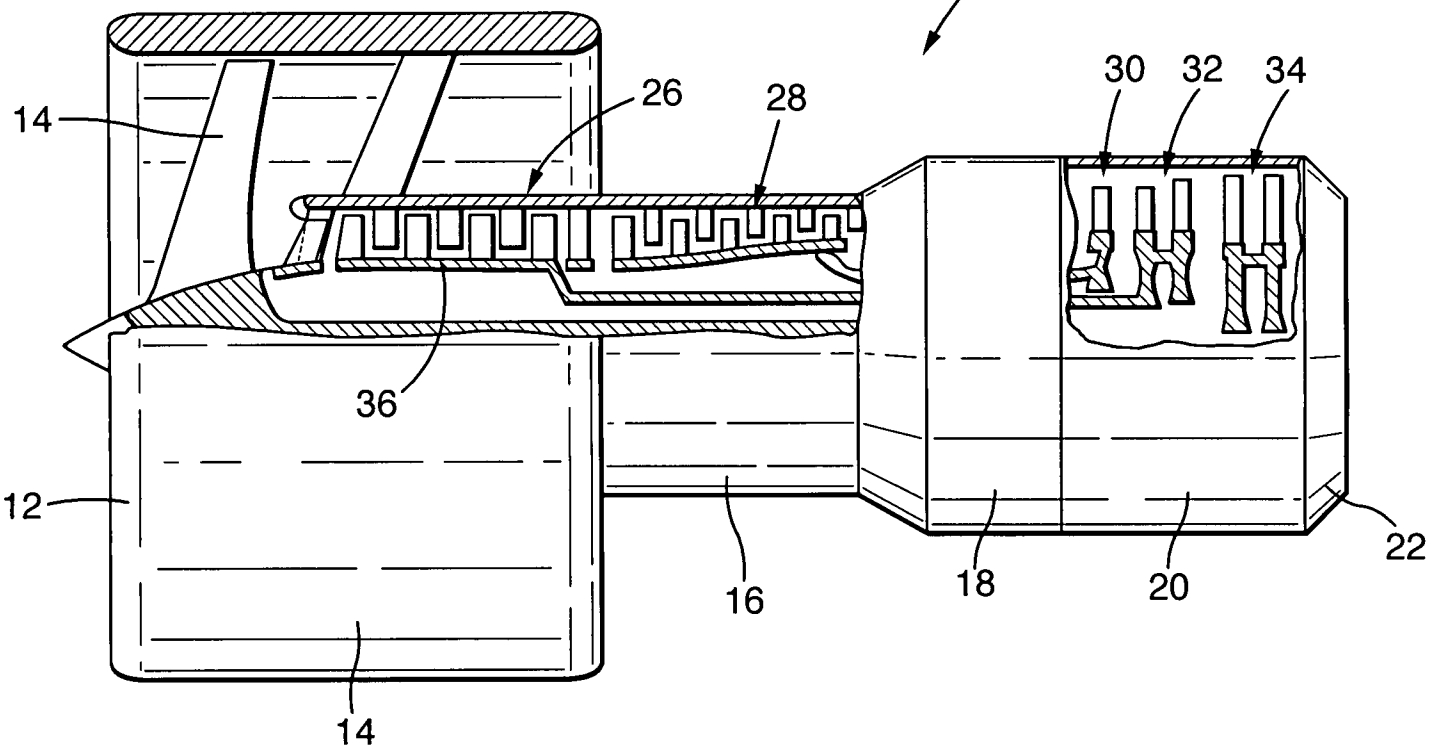
FIG. 1 shows a turbofan gas turbine engine having a damaged abradable coating repaired using a method according to the present invention.

A turbofan gas turbine engine 10, as shown in FIG. 1, comprises an inlet 12, a fan section 14, a compressor section 16, a combustion section 18, a turbine section 20 and an exhaust 22. The fan section 14 comprises a fan 24. The compressor section 16 comprises an intermediate pressure compressor 26 and a high-pressure compressor 28 arranged in flow series. The turbine section 20 comprises a high-pressure turbine 30, an intermediate pressure turbine 32 and a low-pressure turbine 34 arranged in flow series. The low pressure turbine 34 is arranged to drive the fan 24, the intermediate pressure turbine 32 is arranged to drive the intermediate pressure compressor 26 and the high pressure turbine 30 is arranged to drive the high pressure compressor 24.

Figure 2:
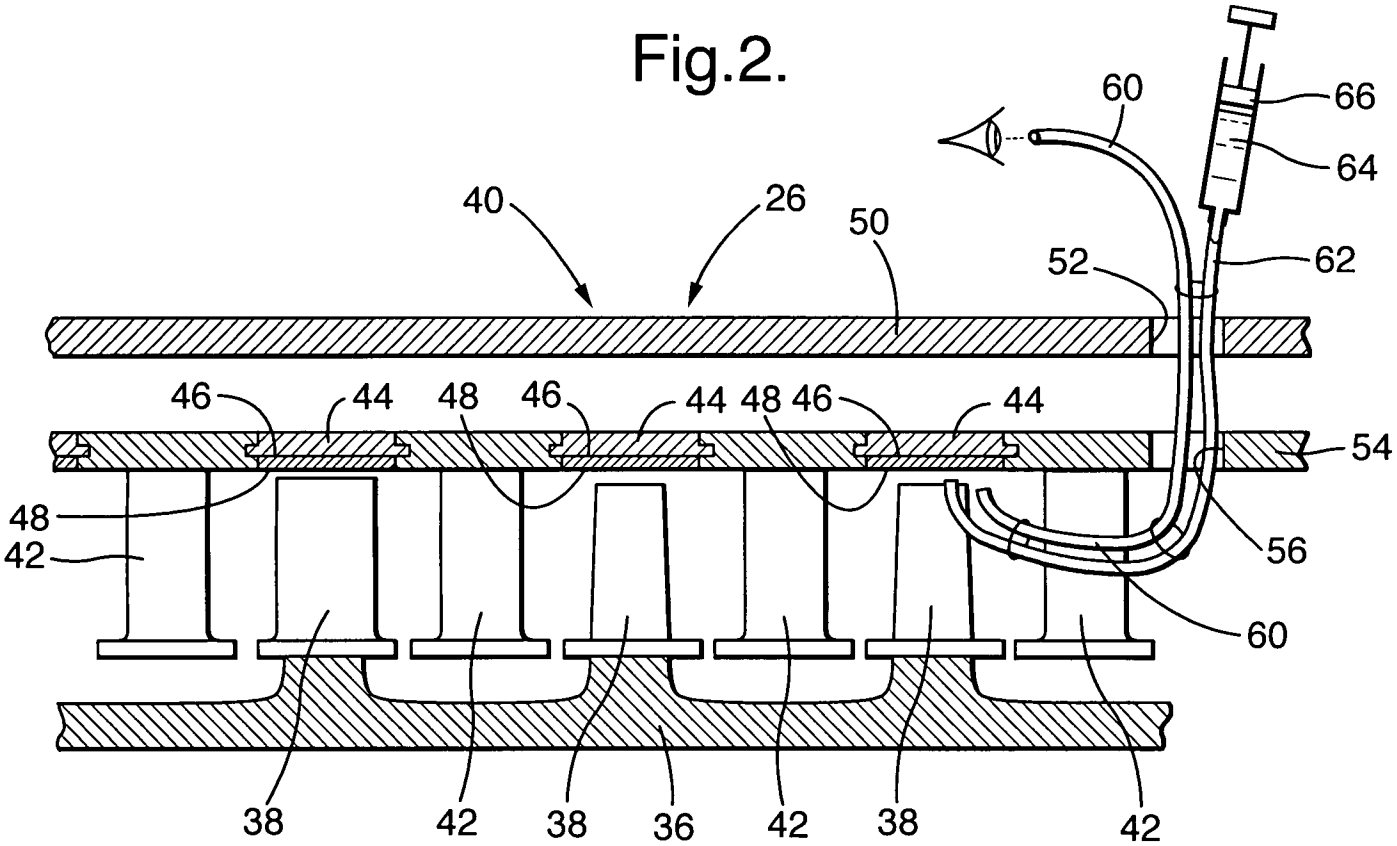
FIG. 2 shows an enlarged cross-sectional view of a surface of a compressor stator component having a damaged abradable coating being repaired using a method according to the present invention.

The intermediate pressure compressor 26, as shown more clearly in FIG. 2, comprises a rotor 36 carrying a plurality of stages of compressor rotor blades 38 and a stator 40 carrying a plurality of stages of compressor stator vanes 42. The compressor rotor blades 38 in each stage are circumferentially spaced and extend generally radially outwardly from the rotor 36. The compressor stator vanes 42 in each stage are circumferentially spaced and extend generally radially inwardly from the stator 40. The stator 40 also comprises a plurality of shrouds 44 interconnecting the stages of compressor stator vanes 42 and the shrouds 44 are positioned radially around a corresponding one of the stages of compressor rotor blades 38. The shrouds 44 have a radially inner surface 46 and the radially inner surface of each shroud 44 is provided with an abradable coating 48. The stator 40 of the intermediate pressure compressor 26 also comprises a casing 50 and the casing 50 is provided with one or more apertures 52 to allow access for boroscopes. In operation of the gas turbine engine 10 the tips of the compressor rotor blades 38 pass close to the shrouds 44 to form a seal and may touch, and wear, the abradable coating 48.

The abradable coating 48 comprises a plasma sprayed abradable coating or a thermally sprayed abradable coating. The abradable coating 48 may comprise aluminium, silicon and hexagonal boron nitride clad powder, e.g. comprising 12 wt % silicon, 16 wt % hexagonal boron nitride and the balance aluminium, or the abradable coating 48 may comprise aluminium, silicon and polyester, e.g. comprising 7 wt % silicon, 40 wt % polyester and the balance aluminium. The abradable coating 48 may comprise MCrAlY and bentonite. M in MCrAlY may be one or more of Ni, Co or Fe.

The high-pressure compressor 28, the low-pressure turbine 30, the intermediate pressure turbine 32 and the low-pressure turbine 34 are also provided with shrouds, which have abradable coatings on their radially inner surfaces.

As mentioned previously, the abradable coatings 48 on the radially inner surface 46 of the shrouds 44 may become damaged during operation of the turbofan gas turbine engine 10.

The present invention provides a method of repairing a damaged abradable coating 48 on the surface 46 of a shroud 44 in an assembled gas turbine engine 10. The method comprises inserting a boroscopes 60 through an aperture 52 in the casing 50 of the intermediate pressure compressor 26 of the gas turbine engine 10. The boroscope 60 is also inserted through an aperture 56 in the radially outer platform 54 of one of the stator vanes 42 of the intermediate pressure compressor 26 of the gas turbine engine 10. The boroscope 60 is arranged to carry a conduit 62. The boroscope 60 and hence the conduit 62 are directed to the damaged abradable coating 48 on the surface 46 of the shroud 44. A liquid abradable glue 64 is supplied from a supply 66, e.g. a syringe etc, through the conduit 62 and the liquid abradable glue 64 is directed/supplied onto the surface 46 of the shroud 44 in the intermediate pressure compressor 26 of the gas turbine engine 10 to repair the damaged abradable coating 48.

Following the deposition of the liquid abradable glue 64, the liquid abradable glue 64 is heated such that the liquid abradable glue 64 hardens. The liquid abradable glue 64 may be heated by running the gas turbine engine 10 for a predetermined time to harden the liquid abradable glue 64. However, other suitable methods of heating the liquid abradable glue 64 to harden it may be used, for example a microwave heater also directed through the aperture 52 in the casing 50 with the boroscope 60 etc. The liquid abradable glue comprises a dislocator.

The liquid abradable glue 64 comprises silica powder, sodium silicate and a dislocator. The dislocator may comprise polyester for low temperature use or graphite or hexagonal boron nitride for high temperature use. This liquid abradable glue 64 comprises in particular a high temperature binary adhesive, Sauereisen 315 (RTM), and a dislocator. Sauereisen 315 (RTM) is a two-part system comprising silica powder and sodium silicate. However, other suitable liquid abradable glues may be used and other suitable dislocators may be used.

Although the present invention has been described with reference to the repair of a damaged abradable coating on a radially inner surface of an intermediate pressure compressor stator shroud it is equally applicable to the repair of the radially inner surfaces of stator shrouds in the high pressure compressor, the high pressure turbine, the intermediate pressure turbine or the low pressure turbine.

Although the present invention has been described with reference to the repair of a damaged abradable coating on an inner surface of a stator shroud it is equally applicable to the repair of abradable coatings on other surfaces of stator or rotor components.

Although the present invention has been described with reference to a turbofan gas turbine engine it is equally applicable to other types of gas turbine engines and is equally applicable to aero gas turbine engines, marine gas turbine engine and industrial gas turbine engines.

Although the present invention has been described with reference to repair of thermally sprayed, or plasma sprayed, abradable coatings it is equally applicable to the repair of cast abradable coatings or other abradable coatings.

The present invention may also be applicable to other types of engine.

The advantage of the present invention is that it allows a damaged abradable coating on a component within an engine to be repaired to extend the life of the abradable coating for a period of time to allow overhaul of the engine to take place at a more convenient time. A further advantage of the present invention is that it allows a damaged abradable coating on a component within an engine to be repaired in situ, e.g. while the gas turbine engine is located on an aircraft, on a ship or in an industrial plant. The present invention allows a Damaged abradable coating on a component within an engine to be repaired without having to remove a module of the engine, or the whole engine, from an aircraft, ship or industrial plant.

I claim:

1. A method of repairing a damaged abradable coating on a surface in an assembled engine without removing a module of the engine from the engine, the method comprising:

(a) inserting a boroscope through an aperture in a casing of the assembled engine, the boroscope carrying a conduit, (b) directing the boroscope to the damaged abradable coating on the surface, (c) supplying a liquid abradable glue through the conduit, and (d) directing the liquid abradable glue onto the surface in the assembled engine to repair the damaged abradable coating, wherein the liquid abradable glue consists of silica powder, sodium silicate and a dislocator, the dislocator being selected from the group consisting of polyester, graphite and hexagonal boron nitride.

2. A method as claimed in claim 1 further comprising heating the liquid abradable glue such that the liquid abradable glue hardens.

3. A method as claimed in claim 2 comprising running the engine for a predetermined time to harden the liquid abradable glue.

4. A method as claimed in claim 2, comprising directing a microwave heater through the aperture in the casing with the boroscope and heating the liquid abradable glue using the microwave heater.

5. A method as claimed in claim 1 wherein the engine comprises a gas turbine engine.

6. A method as claimed in claim 5 wherein the surface is selected from the group consisting of a surface of a compressor stator component and a surface of a turbine stator component.

7. A method as claimed in claim 1 wherein the damaged abradable coating is a plasma sprayed abradable coating or a thermally sprayed abradable coating.

8. A method as claimed in claim 1 wherein the damaged abradable coating comprises aluminium, silicon and hexagonal boron nitride clad powder.

9. A method as claimed in claim 8 wherein the damaged abradable coating comprises 12 wt % silicon, 16 wt % hexagonal boron nitride and the balance aluminium.

10. A method as claimed in claim 1 wherein the damaged abradable coating comprises aluminium, silicon and polyester.

11. A method as claimed in claim 10 wherein the damaged abradable coating comprises 7 wt % silicon, 40 wt % polyester and the balance aluminium.

12. A method as claimed in claim 1 wherein the damaged abradable coating comprises McrAlY and bentonite.

13. A method as claimed in claim 1, wherein the surface is selected from the group consisting of a radially inner surface of a compressor stator component positioned radially around a stage of compressor rotor blades and a radially inner surface of a turbine stator component positioned radially around a stage of turbine rotor blades.

14. A method as claimed in claim 1, wherein the damaged abradable coating comprises a dislocator, the dislocator being selected from the group consisting of polyester, bentonite, and hexagonal boron nitride.

15. A method of repairing a damaged abradable coating on a surface in an assembled gas turbine engine on an aircraft without removing a module of the gas turbine engine from the aircraft, the method comprising:

inserting a boroscope through an aperture in a casing of the assembled gas turbine engine, the boroscope carrying a conduit;

directing the boroscope to the damaged abradable coating on the surface;

supplying a liquid abradable glue through the conduit; and directing the liquid abradable glue onto the surface in the assembled gas turbine engine to repair the damaged abradable coating, wherein the liquid abradable glue consists of silica powder, sodium silicate and a dislocator, the dislocator being selected from the group consisting of polyester, graphite, and hexagonal boron nitride, and the surface being selected from the group consisting of a radially inner surface of a compressor stator component positioned radially around a stage of compressor rotor blades and a radially inner surface of a turbine stator component positioned radially around a stage of turbine rotor blades.

* * * * *